US005403225A

United States Patent [19]

Watkins

[11] Patent Number: 5,403,225

[45] Date of Patent: Apr. 4, 1995

[54] CONFETTI DEVICE

[76] Inventor: James O. Watkins, 14920 Mt. Nebo Rd., Poolesville, Md. 20837

[21] Appl. No.: 80,534

[22] Filed: Jun. 24, 1993

Related U.S. Application Data

[63] Continuation-in-part of Ser. No. 51,355, Apr. 23, 1993, Pat. No. 5,352,148.

[51] Int. Cl.[6] ..... A63H 37/00

[52] U.S. Cl. ..... 446/475; 124/5

[58] Field of Search ..... 446/475, 71, 75, 76, 446/483; 222/129, 156; 273/294; 124/5

[56] References Cited

U.S. PATENT DOCUMENTS

| | | | |
|---|---|---|---|
| 1,034,402 | 7/1912 | Hardy | 273/294 |
| 1,491,809 | 4/1924 | Macchia | 446/475 |
| 1,522,170 | 1/1925 | Yurkanin | 273/294 |
| 1,663,679 | 3/1928 | Carpenter | 446/475 |
| 2,683,604 | 7/1954 | Hassan | 273/294 |
| 3,687,455 | 8/1972 | Odier | 273/294 |
| 4,387,809 | 6/1983 | Botzler | 222/129 |

FOREIGN PATENT DOCUMENTS

| | | | |
|---|---|---|---|
| 458472 | 4/1928 | Germany | 446/491 |
| 17180 | of 1898 | Switzerland | 124/5 |
| 10850 | of 1902 | United Kingdom | 446/475 |
| 2146539 | 4/1985 | United Kingdom | 273/294 |

*Primary Examiner*—Robert A. Hafer
*Assistant Examiner*—Jeffrey D. Carlson
*Attorney, Agent, or Firm*—Ronald B. Sherer

[57] ABSTRACT

An aerial display amusement device comprises an elongated, hollow tube containing a plurality of pieces of confetti within the hollow interior of the tube. The user holds the lower end of the elongated tube and waves the tube forwardly in an arcuate path so as to generate sufficient centrifugal force to eject the confetti out of the tube and upwardly into the air. In the preferred embodiment, the pieces of confetti are of four-sided, tetragonal shape, and pluralities of pieces of confetti are stacked in bundles within the tube such that the bundles exit the tube upwardly in the air and then burst into an aerial display of color and motion as the individual confetti pieces fall downwardly.

17 Claims, 2 Drawing Sheets

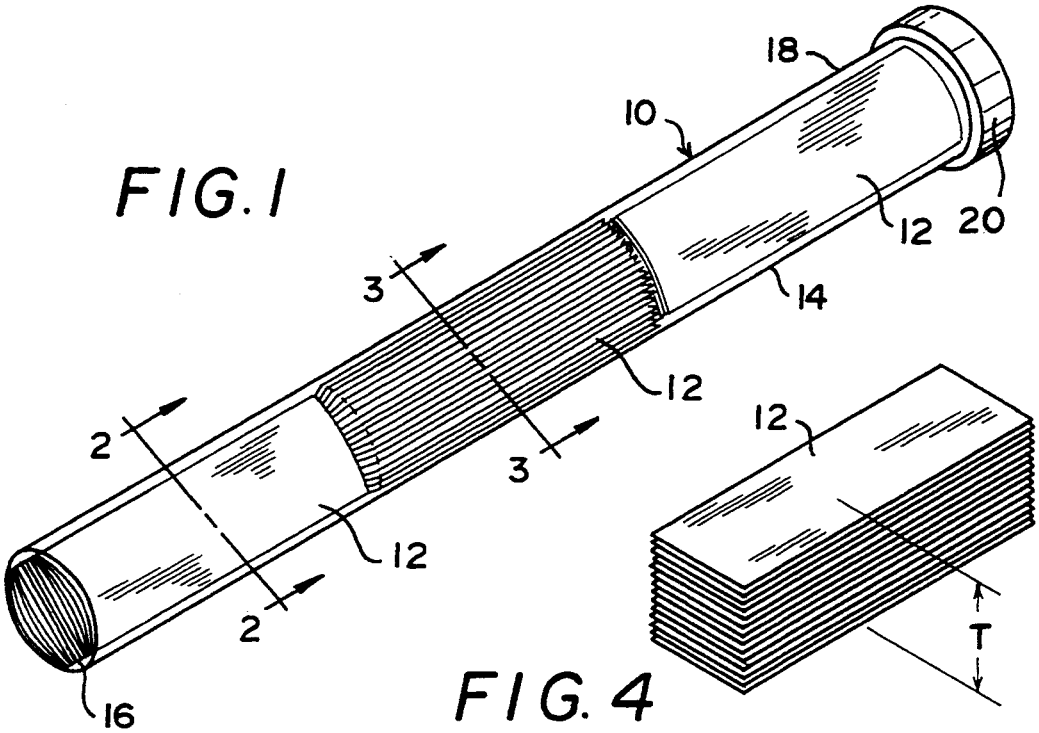
FIG. 1
FIG. 4
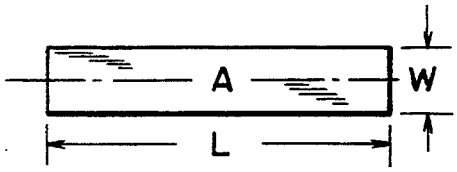
FIG. 5a
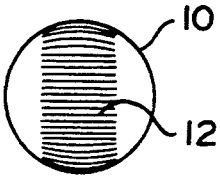
FIG. 2
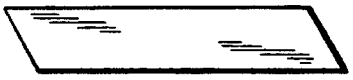
FIG. 5b
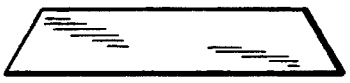
FIG. 5c
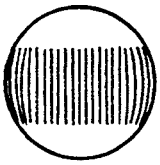
FIG. 3
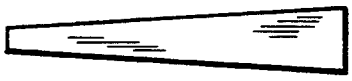
FIG. 5d
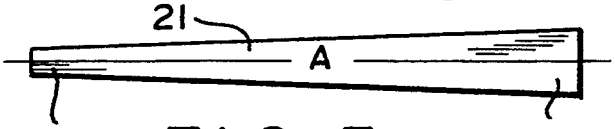
FIG. 5e FIG. 6
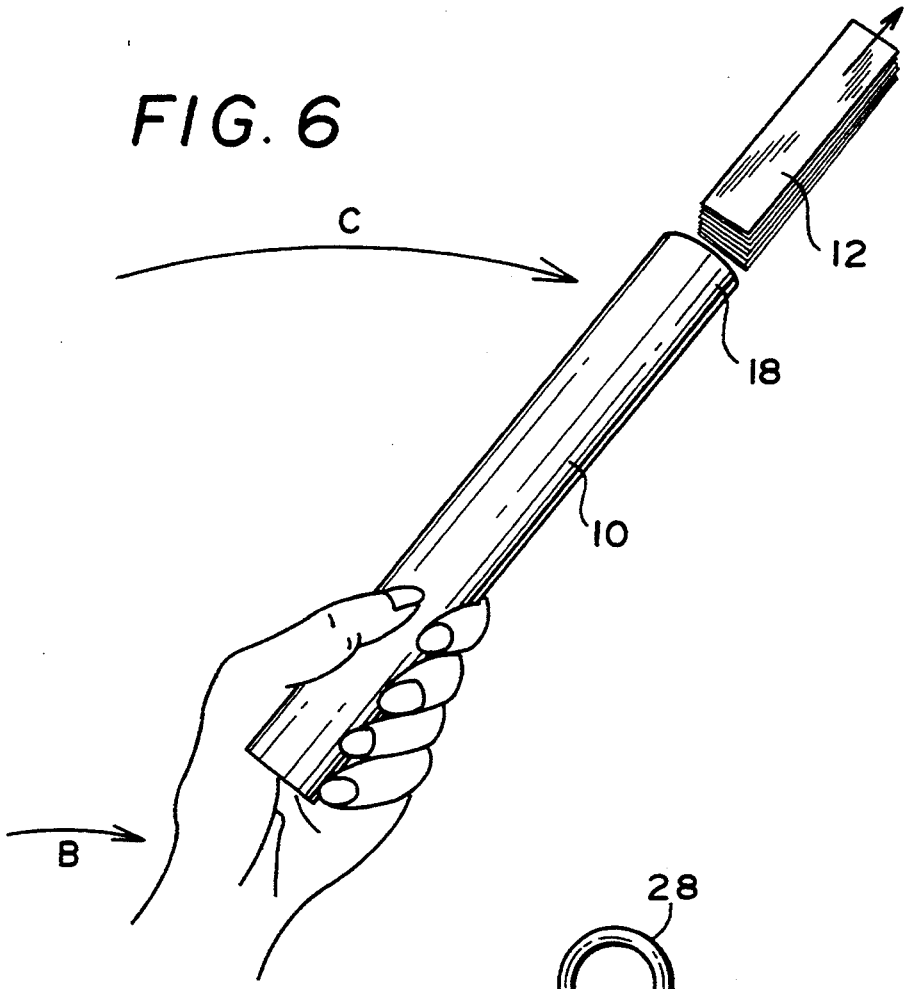
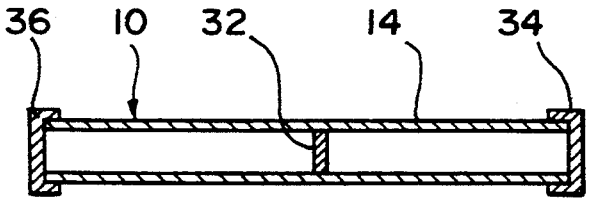
FIG. 8
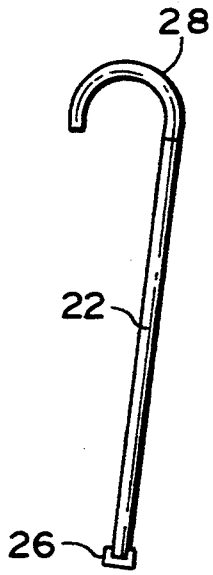
FIG. 7a
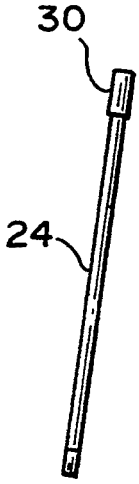
FIG. 7b

CONFETTI DEVICE

This application is a continuation-in-part of application Ser. No. 08/051,355, filed Apr. 23, 1993, now U.S. Pat. No. 5,352,148, the complete disclosure of which is hereby incorporated by reference.

FIELD OF THE INVENTION

This invention relates to amusement devices, and more particularly to a device for launching confetti into the air. More specifically, the present invention relates to a hollow tube or wand which is filled with confetti and which propels the confetti into the air by centrifugal force when the tube is waved forwardly with the arm and with a flick of the wrist motion.

BACKGROUND

Many prior devices have been designed for propelling confetti into the air, but each has had its particular disadvantages. For example, so-called "cannons" or "bombs" have been devised, as described for example in U.S. Pat. Nos. 825,843 and 1,663,679, in which a charge of explosive material is ignited to cause an explosion which drives randomly packed, small round or square pieces of confetti into the air in a generally cloud-like pattern. In addition to not being able to propel the individual pieces of confetti very high into the air, unless large explosive charges are used, the hazard of using any explosive charge is apparent.

Another prior type of device is illustrated in U.S. Pat. Nos. 1,153,207 and 1,491,809 in which horn-shaped devices are filled with randomly packed, small round or square pieces of confetti, and a mouth piece is provided at the small end of the horn for blowing the confetti out of the horn by the breath of the user. Such devices are safe, but the amount of force to expel the confetti is quite limited such that the confetti is not propelled into the air very high or far. Also, the small, random-packed pieces of confetti exit the horn as a cloud rather than rise in the air and then burst into individual pieces.

It is also known to expel confetti from so-called "cannons" by the use of compressed air or $CO_2$ charges, and such cannons are effective at professionally conducted shows where sources of compressed air or $CO_2$ are available. However, such devices are not highly portable, since the cannon must remain connected to the gas source by a flexible hose, or the cannon must include a $CO_2$ cartridge, and such cannons are not safe in the hands of children or non-experienced adults.

SUMMARY

The present invention solves all of the above-indicated problems by providing an extremely simple and safe device whereby children and adults, as well as professionals, may propel confetti high into the air so as to obtain dramatic visual effects. Preferably, the confetti is in the form of bundles or stacks of confetti such that the bundles or stacks burst into hundreds or thousands of pieces of individual confetti, preferably of an elongated rectangular shape to be described, so as to fall slowly to the ground with a floating, fluttering motion.

In the preferred embodiment, the invention comprises a hollow tube, wand or cane which is filled with confetti and which has a closed end and an open end such that when the tube, wand or cane is held near the closed end and waved forwardly with the forearm and with a flick of the wrist motion, the confetti is propelled out of the tube, wand or cane by centrifugal force and is propelled high in the air and then flutters down slowly in a dramatic display of color and motion.

These and other objects and advantages will become apparent from the following description of several illustrative embodiments of the invention as shown in the following illustrative drawings.

BRIEF DESCRIPTION OF DRAWINGS

FIG. 1 is a perspective view of a clear plastic tube filled with bundles of elongated rectangularly shaped confetti;

FIGS. 2 and 3 are cross-sectional views taken along lines 2—2 and 3—3 of FIG. 1;

FIG. 4 is a perspective view of one bundle or stack of confetti before it is inserted into the tube of FIG. 1;

FIGS. *5a–e* are plan views of individual pieces of elongated tetragonal shaped confetti;

FIG. 6 is a perspective view of the tube of FIG. 1 in the hand of a user propelling the bundles or stacks of confetti into the air;

FIGS. *7a* and *b* are elevational views of alternative designs of launching tubes in the form of a dancer's cane and a magician's wand; and FIG. 8 is a cross-sectional view of an alternative form of tube or wand having removable caps at both ends.

DETAILED DESCRIPTION

Referring to FIG. 1, numeral 10 designates an elongated, hollow tube or wand which may be composed of plastic, metal, cardboard or any other material which may be formed into a rigid tube with a relatively smooth interior surface. In the particular embodiment illustrated in FIG. 1, tube 10 is shown as being formed of clear plastic so that the bundles of confetti 12 inside the tube may be seen through the cylindrical wall 14 of the tube; however, the tube may be opaque and colored if desired. While tube 10 may be filled with confetti of any type, the unique and dramatic visual effects of the present invention are best obtained by the use of elongated tetragonal shaped confetti as described in copending application Ser. No. 08/051,355, now U.S. Pat. No. 5,352,148, the complete disclosure which is incorporated by reference herein, and as will be more fully described hereafter.

As further shown in FIG. 1, the lower end of tube 10 has a solid, closed end 16 which may be formed integral with the tube wall 14, or may be formed by a permanent or removable plug or cap. The upper end 18 of the tube is open and is selectively closed by a removable cap 20. In the embodiment of FIGS. 1–3, the length of tube 10 is preferably in the order of about 6 to 18 inches so as to be easily handled by non-professionals including children. The diameter of tube 10, and particularly the inner diameter or I.D., may vary widely depending upon how many pieces of confetti are to be contained. However, it has been found that the best results are obtained with internal diameters of ½ inch or greater, so that there is a sufficient mass of confetti to eject forcefully, and 1 inch or smaller; the preferred internal diameter having been found to be in the range of 0.6 to 0.9 inches or about 0.7 to 0.8 for maximum effectiveness, ease of handling and cost factors.

Referring to bundles 12 of confetti, each piece of confetti is preferably of elongated tetragonal shape as shown in FIGS. *5a–e*. The particular shape of the pieces of confetti may vary from the right-angle rectangle shown in FIG. *5a* and may include a parallelogram, trapezoid or truncated triangle as illustrated in FIGS. 5*b–e*. Each piece is preferably cut from lightweight material such fire-proof, tissue paper, Mylar or the like and is preferably colored and/or shinny; fireproof, biodegradable, colored tissue paper being one preferred material. Each piece has a length L and width W, and a longitudinal axis A. For example, the lengths may be in the order of 1 to 7 inches, preferably 1 to 4.5 inches, and widths of $\frac{1}{4}$ to $\frac{7}{8}$ inches and preferably 5/16 to $\frac{3}{4}$ inches. For maximum fluttering effect when falling, it has been discovered that the L/W ratio should be in the order of 1.75 to 10.0, or 2.5 to 7.0 depending upon the type of falling motion desired as will be more fully described hereinafter. Such four-sided pieces are referred to herein as "elongated tetragonal" shapes, and the shapes illustrated in FIGS. 5*a–d* do not fall to the ground with either a side or end leading in the direction of fall. Rather, such elongated tetragonal pieces of confetti, having L/W ratios in the order of 2.5 to 7.0, fall with their longitudinal axis A substantially parallel to the ground; i.e., substantially horizontally, while each piece rotates about its axis A. Due to the rotating or fluttering action, the pieces fall relatively slowly, and with a horizontal component of movement such that each has a relatively long "hang" time while it flutters to the ground.

Referring to FIG. 5*e*, a piece of elongated tetragonal confetti 21 is illustrated which has an entirely different falling motion than that described with respect to FIGS. 5*a–d*. Confetti piece 21 is in the form of an elongated, truncated triangle having a length in the order of 3–4 inches and a L/W ratio in the order of 7 to 10; the L/W ratio being determined with respect to the wider end 23. This forms a relatively longer and relatively narrower truncated triangle than that shown in FIG. 5*d*. For example, the width of end 25 may be in the order of 1/16 to $\frac{1}{4}$ of an inch. When piece 21 falls through the air, it falls with the narrow end 25 leading in the direction of fall with the piece rotating about axis A which extends vertically instead of horizontally. As piece 21 falls in this vertical orientation, the ends 23 and 25 tend to flutter laterally relative to the mid-portion such that the motion is that of a corkscrew twirling to the ground. In addition to fluttering vertically instead of horizontally, confetti pieces in the shape described with respect to FIG. 5*e* fall faster than those described with respect to FIGS. 5*a–d*. Thus, when both types of elongated tetragonal shapes are released in the air together, there is the unique visual effect of some pieces fluttering horizontally and falling relatively slowly while others twirl vertically and fall more rapidly through the mass of more slowly falling pieces.

Referring to FIGS. 1–4, each of bundles 12 is composed of stacked pieces of elongated tetragonal confetti, known under the trademark Flutter Fetti confetti, and each bundle or stack 12 is slid into the tube from open end 18 until the tube is substantially filled as shown in FIG. 1. While all of the bundles may be slid into the tube with the layers of Flutter Fetti confetti oriented in parallel planes, it is preferred that the layers of the bundles be oriented at an angle with respect to each other as illustrated in FIGS. 1–3. This angled orientation of the layers prevents pieces from one bundle from passing into the adjacent bundle and thereby keeps each bundle intact until it is launched and during launch.

For maximum effectiveness in being propelled out of the tube to reach maximum height in the air, it is important that each bundle have sufficient pieces of confetti such that the bundle is compressed, but only slightly compressed, as it slides into the tube. That is, if the thickness T of the bundle prior to being inserted into the tube is less than the I.D. of the tube, the bundle will tend to slide out of the tube too easily and before the maximum centrifugal force is obtained. On the other hand, the bundle must not be wedged in the tube so tightly that it cannot be thrown out by the centrifugal force developed by the forearm and wrist, or such that it is difficult to slide out of the tube. Accordingly, it is preferred that the number of pieces of confetti forming the thickness of the bundle be such that, when the bundle is inserted into the tube and slightly compressed therein, the first few layers of confetti directly adjacent the curved inner wall of the tube become slightly curved by the wall as shown in FIGS. 2 and 3. This provides sufficient friction against the inner side wall of the tube such that the bundle does not fall out of the tube when it is tested by inverting the tube with the open end facing downwardly. If more than the first few layers of confetti are forced to be curved, such that the inner layers are compacted, the bundle will be held too tightly and some layers of confetti should be removed. Thus, for a given I.D., and for confetti material of a given type, the proper thickness of the confetti bundle will easily be determined as described above. Of course, the width of the bundle should be less than the I.D. of the tube such as, for example, a width of $\frac{1}{4}$ to 5/8 inches for a tube having an I.D. of $\frac{3}{4}$ inches.

OPERATION

Once tube 10 has been filled with bundles 12 of confetti, cap 20 is put on the tube to close open end 18 for shipment and storage until use. When it is desired to use the tube, cap 20 is removed and the lower portion of the tube is held in the hand as illustrated in FIG. 6. The forearm is first pulled back, and then waved forward in a rapid motion, along with a forward flicking of the wrist, as represented by arrow B, such that tube 10 moves through an arcuate path as represented by arrow C. This arcuate movement produces a centrifugal force acting on the confetti bundles 12 such that they are rapidly propelled out of the open end of the tube as shown in FIG. 6.

It should be noted that the bundles 12 do not immediately burst into individual pieces of Flutter Fetti confetti at the instant of leaving the open end 18 of tube 20 as is the case with random or loose-packed confetti. While the reasons are not fully known, and such reasons form no part of the present invention, there is a distinct tendency of the bundles 12 of the present invention to remain intact as they are ejected from the tube, and at least portions of most bundles continue to remain intact as they rise into the air. Of course, some of the individual pieces of Flutter Fetti confetti separate from the bundle as each bundle flies upwardly in the air. However, whether due to static electricity, humidity, compression of the bundle in the tube or other factors, significant portions of the bundles tend to remain together and reach heights of 10–15 feet in the air before the remaining portions of the bundles burst into hundreds or thousands of pieces. Once having reached their maximum height, the hundreds or thousands of pieces of Flutter Fetti confetti then begin their relatively slow, fluttering decent as each piece rotates horizontally about its longitudinal axis thereby producing a fluttering motion. In addition, if pieces shaped as described with reference to FIG. 5*e* are present, they spiral and twirl vertically as they fall at a faster rate through the other pieces.

From the foregoing description, it will be apparent that, whether in the hand of a professional showman, an amateur or a child, one six inch wand filled with Flutter Fetti confetti, such wand being known under the trademark Flutter Flicker, can produce a dramatic display of color and motion with no hazards and without any expensive equipment as is required for compressed air or $CO_2$ cannons. It will also be apparent that many variations and alternative designs are possible, such as the hollow dancer's cane 22 shown in FIG. *7a*, or the hollow magician's wand 24 shown in FIG. *7b*. In these embodiments, the tube portion may be 12 inches to 3 feet in length. In the case of the dancer's cane, the bottom may be closed by a permanent or removable cap 26, and/or the handle 28 may be removable such that, during the dance routine, the removable closure is removed and waving movement of the cane produces the dramatic display described above. Similarly, the handle of the magician's wand may be removed and, with a wave of the wand, a burst and shower of color and motion is suddenly created.

In the case of the dancer's cane, or the magician's wand, or any other device such as tube 10 of FIG. 1, or a Baton-twirler for example, the tube wall 14 may be divided along its length by a divider or partition wall 32 which is secured to the tube wall 14 as shown in FIG. 8. By providing two removable closures 34 and 36, one of which may be handle 28 of cane 22 or handle 30 of wand 24, the performer may remove one closure and produce a first burst of color, and later remove the second closure and produce a second, surprise burst of color. Accordingly, it will be readily apparent that many other embodiments and variations may be designed based upon the principles of the present invention. Therefore, it is to be understood that the foregoing description of several embodiments is purely illustrative rather than limiting of the invention, and that the legal scope of the invention is not to be limited other than as set forth in the following claims including all legal equivalents thereof.

What is claimed is:

1. An aerial display confetti device comprising in combination:

(a) an elongated, hollow tube having first and second ends and a hollow interior, said tube having a substantially constant diameter along its elongated length and having substantially smooth interior walls;

(b) a plurality of tetragonal shaped pieces of confetti positioned within said tube, each of said tetragonal pieces of confetti having a central axis, (c) said plurality of pieces of confetti being stacked with said axes parallel to each other and to the elongated length of said tube to form at least one bundle of confetti of predetermined size positioned within said tube, and (d) said at least one bundle of confetti extending diametrically across the hollow interior of said tube in a predetermined amount of frictional contact with said interior walls such that, upon rapid arcuate movement of said tube, said at least one bundle of confetti is forcefully ejected by centrifugal force from said tube as a bundle upwardly into the air.

2. The confetti device of claim 1 wherein the length of said elongated tube is in the order of 6 to 18 inches.

3. The confetti device of claim 1 wherein the length of said elongated tube is in the order of 18 inches to 3 feet.

4. The confetti device of claim 1 wherein said tube is in the shape of a dancer's cane.

5. The confetti device of claim 1 wherein said tube is in the shape of a magician's wand.

6. The confetti device of claim 1 wherein the length to width ratio of the tetragonal pieces of confetti is in the order of 1.75 to 10.0.

7. The aerial display confetti device as claimed in claim 1 wherein said plurality of pieces of confetti are stacked in a plurality of bundles within said tube, and said bundles are positioned adjacent each other along the length of said elongated tube.

8. The aerial display confetti device as claimed in claim 1 wherein one of said ends is open and said predetermined amount of frictional contact between said at least one bundle and said interior walls of the tube is sufficient to prevent the bundle from falling out of the tube under the force of gravity when said open end is pointed downwardly.

9. The confetti device of claim 1 wherein the internal diameter of said tube is in the order of ½ to 1 inch and the width of said tetragonal pieces of confetti is in the order of 5/16 to ¾ of an inch.

10. The confetti device of claim 7 wherein the stacked bundles comprise layers of elongated tetragonal confetti, and the layers of adjacent bundles are oriented at an angle with respect to each other.

11. A method of launching confetti upwardly into the air to form an aerial display of confetti comprising:

(a) forming a large plurality of pieces of confetti in at least one stacked bundle, each of said pieces of confetti having a central axis and said axes being aligned parallel to each other in said stacked bundle;

(b) inserting said at least one bundle of confetti into an elongated, hollow tube having a closed end and an open end, said axes being aligned parallel to the length of said elongated tube, and said bundle extending across the diameter of said tube, such that said bundle remains in an aligned stack within said tube;

(c) holding said elongated tube adjacent said closed end with said open end pointed substantially upwardly; and (d) moving said elongated tube in an arcuate path sufficiently rapidly to generate sufficient centrifugal force to eject said bundle of confetti from said open tube end upwardly into the air as a bundle to form an aerial display of individual pieces of confetti.

12. The method of claim 11 wherein the step of forming the large plurality of pieces of confetti in at least one stacked bundle includes the step of forming said pieces of confetti in tetragonal shapes.

13. The method of claim 12 wherein the step of forming the large plurality of pieces of confetti in at least one stacked bundle includes the step of forming said pieces of confetti in elongated, tetragonal shapes.

14. The method of claim 11 wherein the number of pieces of confetti comprising said at least one bundle is sufficient to cause said at least one bundle to extend across the interior diameter of said hollow tube and frictionally engage the interior walls of said tube with a predetermined amount of friction sufficient to prevent said at least one bundle from falling out of the tube under the force of gravity when said open tube end is pointed downwardly.

15. An aerial display confetti device comprising:

(a) an elongated hollow tube having first and second open ends, said tube having a length in the order of 1 to 3 feet, (b) means forming a divider within said hollow tube for dividing said hollow tube into first and second compartments, (c) a large plurality of pieces of confetti, said confetti pieces being of tetragonal shape, (d) said plurality of tetragonal shaped confetti pieces being stacked to form at least first and second bundles of tetragonal shaped confetti, (e) said first bundle of tetragonal shaped confetti being positioned within said first compartment and said second bundle of tetragonal shaped confetti being positioned within said second compartment, and (f) first and second removable closure means removably closing said first and second open ends such that, when said first closure means is removed from said first open end and said tube is waved in an arcuate path, said first bundle of confetti is injected into the air under centrifugal force, and subsequently upon removal of said second closure means from said second open end and said tube is waived in an arcuate path, said second bundle of confetti is injected into the air under centrifugal force.

16. A new use for an elongated hollow tube comprising the steps of:

(a) cutting a large plurality of pieces of confetti from lightweight material, said pieces of confetti having elongated, tetragonal shapes, (b) inserting a large plurality of said elongated, tetragonal-shaped pieces of confetti into said elongated hollow tube with the elongated length of said pieces aligned parallel to each other and to the elongated length of said tube to form an aligned stack of confetti extending across the diameter of said tube as an intact bundle, (c) holding said elongated tube adjacent one end and moving said tube rapidly in an arcuate path with the forearm and wrist with sufficient speed to eject said bundle of pieces of tetragonal-shaped confetti from said tube and into the air.

17. A large plurality of identical pieces of confetti, said pieces being stacked in a bundle, and said bundle being disposed within an elongated hollow tube, said plurality of pieces being sufficient for said bundle to extend across the diameter of said tube in frictional contact with said tube, and the lengths of said pieces being parallel to each other and to the elongated length of said tube.

* * * * *